US011129411B2

(12) United States Patent
Crosby

(10) Patent No.: US 11,129,411 B2
(45) Date of Patent: Sep. 28, 2021

(54) MULTIPURPOSE SNUFFER DEVICE

(71) Applicant: Judson Crosby, Girwood, AK (US)

(72) Inventor: Judson Crosby, Girwood, AK (US)

( * ) Notice: Subject to any disclaimer, the term of this patent is extended or adjusted under 35 U.S.C. 154(b) by 673 days.

(21) Appl. No.: 16/036,403

(22) Filed: Jul. 16, 2018

(65) Prior Publication Data

US 2019/0014816 A1 Jan. 17, 2019

Related U.S. Application Data

(60) Provisional application No. 62/533,374, filed on Jul. 17, 2017.

(51) Int. Cl.
*A24F 9/00* (2006.01)
*A24F 13/18* (2006.01)

(52) U.S. Cl.
CPC ..... *A24F 9/00* (2013.01); *A24F 13/18* (2013.01); *A24F 2700/08* (2013.01)

(58) Field of Classification Search
CPC ..... A24F 2700/08; A24F 13/24; A24F 13/18; A24F 9/00; A24F 5/10
USPC ..... 131/176, 178
See application file for complete search history.

(56) References Cited

U.S. PATENT DOCUMENTS 1,934,115 A * 11/1933 Burns ..... A24F 9/16 206/244
2,136,537 A * 11/1938 Bergman ..... A24F 5/10 131/177
3,220,420 A * 11/1965 Genoud ..... F23Q 2/32 131/247
3,263,690 A 8/1966 Buckley
4,318,416 A * 3/1982 Thornhill ..... A24F 9/02 131/243
8,291,917 B2 10/2012 Sweeney
D729,442 S 5/2015 Albers
D738,568 S 9/2015 Bennett
2008/0142026 A1 6/2008 Chou
2010/0101591 A1* 4/2010 Rosso ..... A24F 9/02 131/247
2013/0008455 A1 1/2013 Healy et al.
2013/0199548 A1* 8/2013 Bodenchuk ..... A24F 9/02 131/247

* cited by examiner

*Primary Examiner* — Michael H. Wilson
*Assistant Examiner* — Yana B Krinker
(74) *Attorney, Agent, or Firm* — Boudwin Intellectual Property; Daniel Boudwin

(57) ABSTRACT

A multipurpose snuffer device is provided. The device includes a sleeve, configured to receive and secure a lighter therein, and a circular lower cylinder, having a convex protrusion having a flexible lip member that is configured to snugly fit around a top edge of a pipe bowl and extinguish a burning material in the pipe bowl. The device may further include a circular intermediate cylindrical cavity, within the circular lower cylinder, configured to store a material capable of burning in the pipe bowl. The circular intermediate cylindrical cavity may be accessed by removing a bottom portion of the circular lower cylinder from an upper portion of the circular lower cylinder. The invention is useful for storing and organizing a plurality of items and functionalities of interest to a smoker, including a lighter, a material capable of burning in the pipe bowl, and a pipe extinguishing structure and functionality.

14 Claims, 4 Drawing Sheets

MULTIPURPOSE SNUFFER DEVICE

CROSS REFERENCE TO RELATED APPLICATIONS

This application claims priority under 35 U.S.C. § 119(e) to U.S. Provisional Application No. 62/533,374 filed on Jul. 17, 2017. The above identified patent application is incorporated by reference herein in its entirety to provide continuity of disclosure.

BACKGROUND OF THE INVENTION

After a material in a pipe has been lit, the material in the pipe can continue to burn, despite a lack of use of the pipe by a user. The continued burning of the material can be hazardous, because an accidental spill of the material can start a fire. Additionally, unless the pipe is promptly used, the continued burning of the material will waste the material.

Therefore, there is a need in the art for a safe, quick, and convenient way to extinguish a lit pipe, thereby preserving the material and minimizing a risk of accidental fires. The present invention addresses this unmet need.

FIELD OF THE INVENTION

The present invention relates to a multipurpose pipe snuffer device for extinguishing a lit pipe.

Devices have been disclosed in the art that relate to pipe accessories. These include devices that have been patented and published in patent application publications. These devices are often inconvenient to use. In view of the devices disclosed in the art, it is submitted that there is a need in the art for an improvement to existing pipe accessories. In view of the present disclosure, it is submitted that the present invention substantially diverges in structural and functional elements from devices in the art, and the instant invention substantially fulfills an unmet need in the art.

SUMMARY OF THE INVENTION

In view of the disadvantages inherent in the known types of snuffer devices in the art, the present invention provides a new and improved multipurpose snuffer device, wherein the same can be utilized for storing a lighter, extinguishing a pipe, and optionally, storing a material to be smoked in a pipe.

It is therefore an object of the present invention to provide a multipurpose snuffer device for conveniently storing a lighter and extinguishing a pipe.

It is another object of the present invention to provide a multipurpose snuffer device for conveniently storing a lighter, extinguishing a pipe, and storing a material to be smoked in a pipe.

Another object of the present invention is to provide a multipurpose snuffer device that may be readily manufactured from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of the invention will be particularly pointed out in the claims, the invention itself and manners in which it may be made and used may be better understood after a review of the following description, taken in connection with the accompanying drawings, wherein like numeral annotations are provided throughout.

DETAILED DESCRIPTION OF THE INVENTION

Figure 1:
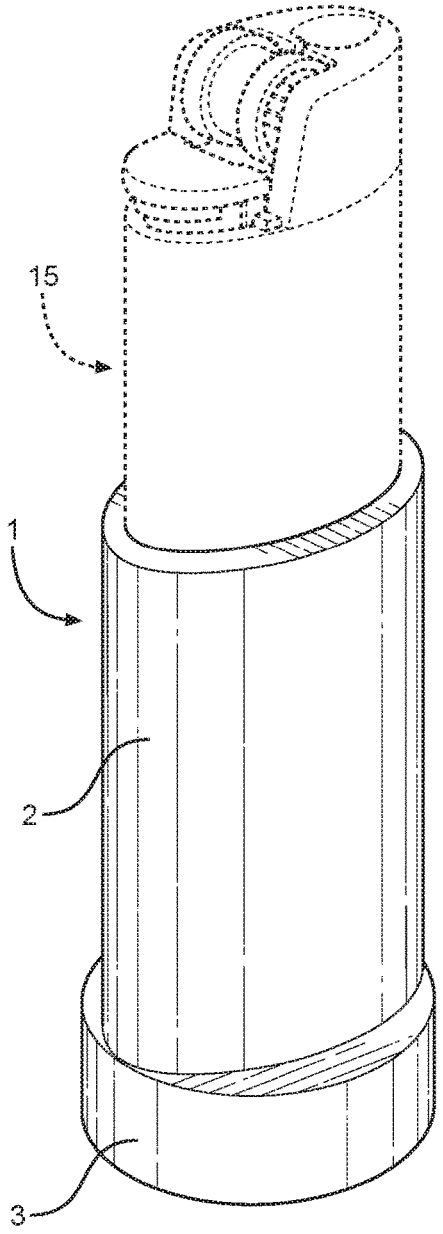
FIG. 1 depicts a first perspective view of a first exemplary embodiment of a multipurpose snuffer device.

Reference is made herein to the attached drawings. Like reference numerals are used throughout the drawings to depict like or similar elements of the multipurpose snuffer device. The figures are intended for representative purposes only and should not be considered limiting in any respect.

In one aspect, the invention provides a multipurpose snuffer device, comprising: an elongated body comprising an upper end comprising a sleeve, and a lower end comprising a circular lower cylinder; wherein the sleeve is parallel to the circular lower cylinder; wherein the upper end is connected to the lower end; wherein the sleeve is configured to receive and secure a lighter therein; wherein the circular lower cylinder comprises a circular convex protrusion comprising a circular flexible lip member configured to snugly fit around a top edge of a pipe bowl and extinguish a burning material in the pipe bowl.

In various embodiments of the invention, the multipurpose snuffer device comprises a circular intermediate cylindrical cavity within the circular lower cylinder, configured to store a material capable of burning in the pipe bowl; wherein the circular intermediate cylindrical cavity is opened by removing a lower portion of the circular lower cylinder from an upper portion of the circular lower cylinder; wherein the circular intermediate cylindrical cavity is closed by securing the lower portion of the circular lower cylinder to the upper portion of the circular lower cylinder.

In various embodiments of the invention, the lower portion of the circular lower cylinder comprises a circular ridge on an outer circumference of the lower portion of the circular lower cylinder, and the upper portion of the circular lower cylinder comprises a groove in an inner circumference of the upper portion of the circular lower cylinder, wherein the groove is configured to receive and secure the ridge; the circular ridge is a spiral circular ridge; the sleeve is trimmable; the sleeve is elliptical and cylindrical; the circular lower cylinder comprises a hole on the upper portion of the circular lower cylinder, configured to receive and secure a tool; the multipurpose snuffer device is constructed of silicone; the multipurpose snuffer device has a height of about two inches, a width of about one inch, and a thickness of about one quarter inch; and/or the multipurpose snuffer device has a height of two inches, a width of one inch, and a thickness of one quarter inch.

Reference is now made to the drawings, which depict one or more exemplary embodiments of the invention.

Referring now to FIG. 1, there is depicted a first perspective view of a first exemplary embodiment of a multipurpose snuffer device. A lighter 15 is contained within a sleeve 2 of the multipurpose snuffer device 1; the lighter 15 forms no part of the invention but is included to illustrate a feature of the invention. In the shown embodiment, the sleeve 2 is an elliptical cylinder located on an upper end of an elongated body of the multipurpose snuffer device 1, configured to receive a lighter through an upper end thereof, and secure the lighter therein by friction. In this way, the lighter is removably secured within the sleeve 2, such that the lighter does not fall from the sleeve during handling or transport. The sleeve 2 is attached on a lower end thereof to a circular lower cylinder 3. The circular lower cylinder 3 is configured to rest on a flat surface and maintain the multipurpose snuffer device 1 in an upright position.

Figure 2:
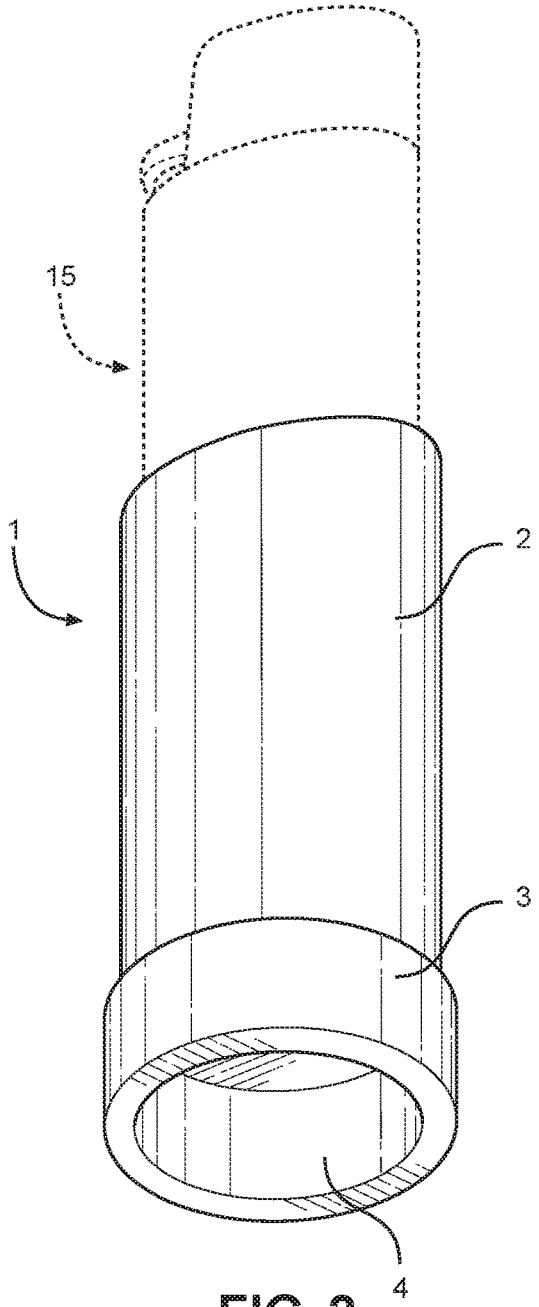
FIG. 2 depicts a second perspective view of the first exemplary embodiment of a multipurpose snuffer device.

Referring now to FIG. 2, there is depicted a second perspective view of the first exemplary embodiment of a multipurpose snuffer device. A lighter 15 is contained within the sleeve 2 of the multipurpose snuffer device 1; the lighter 15 forms no part of the invention but is included to illustrate a feature of the invention. The circular lower cylinder 3 comprises a circular convex protrusion 4 comprising a circular flexible lip member, which is configured to snugly fit around a top edge of a pipe bowl and extinguish a burning material in the pipe bowl. The flexibility of the circular flexible lip member enables the multipurpose snuffer device to accommodate pipe bowls of various dimensions and shapes. This ensures an airtight fit of the circular flexible lip member around the top edge of the pipe bowl, which deprives the burning material of oxygen, thereby extinguishing the material and stopping the material from burning further.

Figure 3:
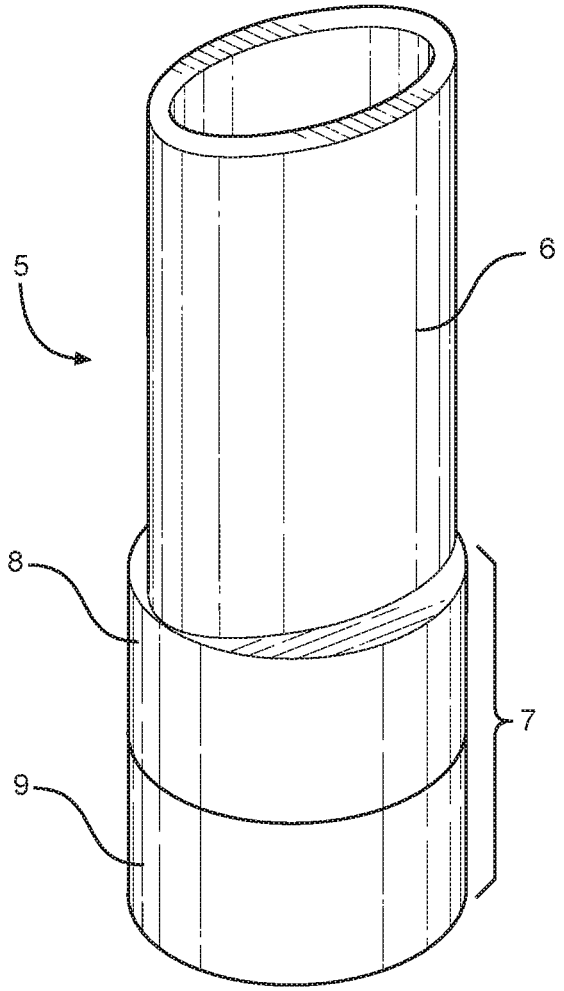
FIG. 3 depicts a first perspective view of a second exemplary embodiment of a multipurpose snuffer device.

Referring now to FIG. 3, there is depicted a first perspective view of a second exemplary embodiment of a multipurpose snuffer device. In the shown embodiment, the sleeve 6 is an elliptical cylinder located on an upper end of an elongated body of a multipurpose snuffer device 5, configured to receive a lighter through an upper end thereof, and secure the lighter therein by friction. In this way, the lighter is removably secured within the sleeve 6, such that the lighter does not fall from the sleeve during handling or transport. The sleeve 6 is attached on a lower end thereof to a circular lower cylinder 7. The circular lower cylinder 7 comprises an upper portion 8 and a lower portion 9, which attach to one another to form a closed position, as shown. In some embodiments, a surface of the upper portion 8 is flush with a surface of the lower portion 9 when the multipurpose snuffer device 5 is in a closed position. The circular lower cylinder 7 is configured to rest on a flat surface and maintain the multipurpose snuffer device 5 in an upright position. The circular lower cylinder 7 comprises a circular convex protrusion, at a bottom of the lower portion 9, comprising a circular flexible lip member, which is configured to snugly fit around a top edge of a pipe bowl and extinguish a burning material in the pipe bowl. The flexibility of the circular flexible lip member enables the multipurpose snuffer device to accommodate pipe bowls of various dimensions and shapes. This ensures an airtight fit of the circular flexible lip member around the top edge of the pipe bowl, which deprives the burning material of oxygen, thereby extinguishing the material and stopping the material from burning further.

Figure 4:
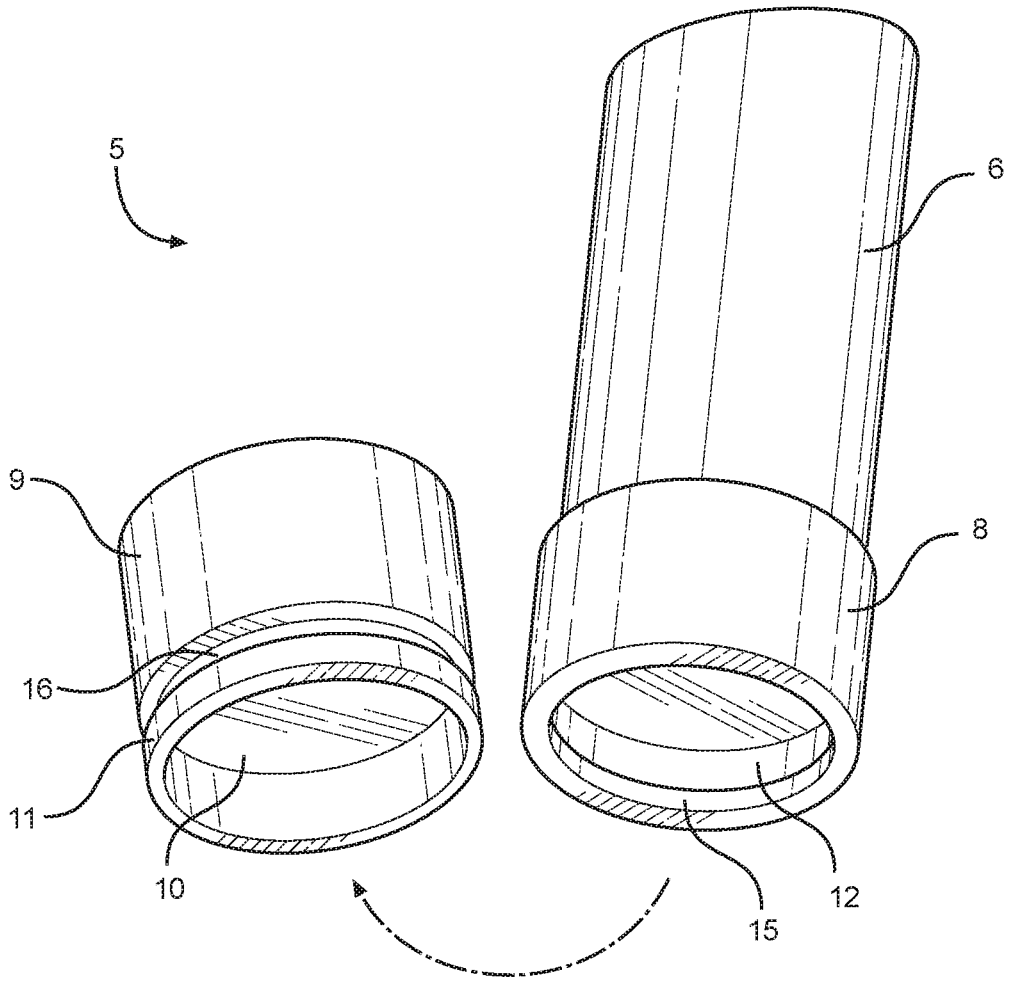
FIG. 4 depicts a second perspective view of the second exemplary embodiment of a multipurpose snuffer device.

Referring now to FIG. 4, there is depicted a second perspective view of the second exemplary embodiment of a multipurpose snuffer device. The multipurpose snuffer device 5 is in an open position, revealing a circular intermediate cylindrical cavity 10. The multipurpose snuffer device 5 may be secured in the closed position by applying one or more forces to the multipurpose snuffer device 5, thereby positioning a circular ridge 11 of the lower portion 9 into a groove 12 of the upper portion 8, and positioning a circular ridge 15 of the upper portion 8 into a groove 16 of the lower portion 9. In this embodiment, the groove 12 is configured to receive the circular ridge 11 therein, and the groove 16 is configured to receive the circular ridge 15 therein, such that the lower portion 9 is removably secured to the upper portion 8 via a friction fit. The circular intermediate cylindrical cavity 10 is configured to store a material capable of burning in the pipe bowl. In this way, a user can conveniently and easily refill the pipe bowl after extinguishing and removing the contents thereof.

Figure 5:
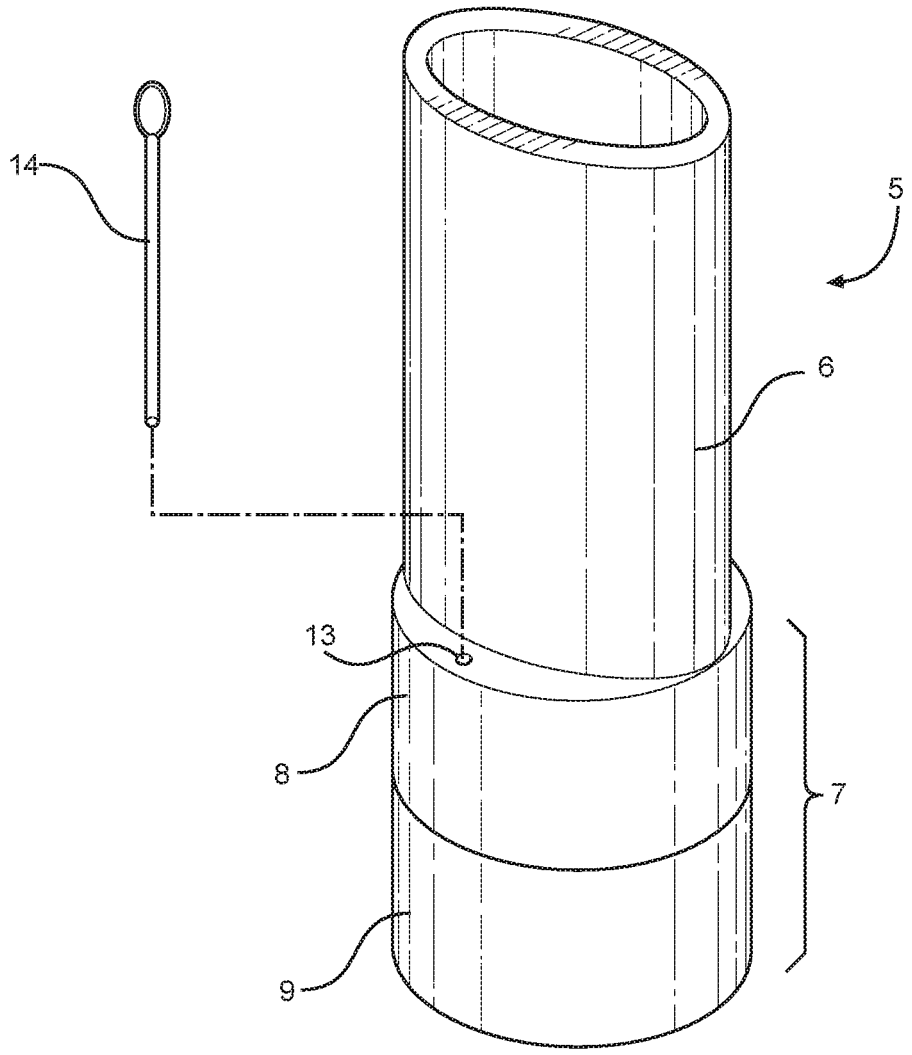
FIG. 5 depicts a third perspective view of the second exemplary embodiment of a multipurpose snuffer device.

Referring now to FIG. 5, there is depicted a third perspective view of the second exemplary embodiment of a multipurpose snuffer device. An optional hole 13 is located on a surface of the circular lower cylinder 7 and is configured to receive and secure an optional tool 14. In the shown embodiment, the tool 14 comprises a rod having a swab at a distal end thereof, wherein the hole 13 is dimensioned to receive the rod therein. In this way, the tool 14 is readily available to the user should the user need to clean or maintain the pipe bowl.

The foregoing descriptions of specific embodiments of the present invention have been presented for purposes of illustration and description. They are not intended to be exhaustive or to limit the present invention to the precise forms disclosed, and modifications and variations are possible in view of the above teaching. The exemplary embodiment was chosen and described to best explain the principles of the present invention and its practical application, to thereby enable others skilled in the art to best utilize the present invention and its embodiments with modifications as suited to the use contemplated.

It is therefore submitted that the instant invention has been shown and described in the most practical and exemplary embodiments. It should be recognized that departures may be made which fall within the scope of the invention. With respect to the description provided herein, it is submitted that the optimal features of the invention include variations in size, materials, shape, form, function and manner of operation, assembly, and use. All structures, functions, and relationships equivalent or essentially equivalent to those disclosed are intended to be encompassed by the present invention.

I claim:

1. A multipurpose snuffer device, comprising:

an elongated body comprising an upper end comprising a sleeve, and a lower end comprising a circular lower cylinder;

wherein the sleeve is parallel to the circular lower cylinder;

wherein the upper end is connected to the lower end;

wherein the sleeve is configured to receive and secure a lighter therein;

wherein the circular lower cylinder comprises a circular convex protrusion comprising a circular flexible lip member configured to snugly fit around a top edge of a pipe bowl and extinguish a burning material in the pipe bowl.

2. The multipurpose snuffer device of claim 1, comprising a circular intermediate cylindrical cavity within the circular lower cylinder, configured to store a material capable of burning in the pipe bowl;

wherein the circular intermediate cylindrical cavity is opened by removing a lower portion of the circular lower cylinder from an upper portion of the circular lower cylinder;

wherein the circular intermediate cylindrical cavity is closed by securing the lower portion to the upper portion.

3. The multipurpose snuffer device of claim 2, wherein the lower portion comprises a circular ridge on an outer circumference of the lower portion, and the upper portion comprises a groove in an inner circumference of the upper portion, wherein the groove is configured to receive and secure the ridge.

4. The multipurpose snuffer device of claim 3, wherein the circular ridge is a spiral circular ridge.

5. The multipurpose snuffer device of claim 2, wherein the sleeve is elliptical and cylindrical.

6. The multipurpose snuffer device of claim 2, wherein the circular lower cylinder comprises a hole on the upper portion, configured to receive and secure a tool.

7. The multipurpose snuffer device of claim 2, wherein the multipurpose snuffer device is constructed of silicone.

8. The multipurpose snuffer device of claim 2, wherein the multipurpose snuffer device has a height of about two inches, a width of about one inch, and a thickness of about one quarter inch.

9. The multipurpose snuffer device of claim 8, wherein the multipurpose snuffer device has a height of two inches, a width of one inch, and a thickness of one quarter inch.

10. The multipurpose snuffer device of claim 1, wherein the sleeve is elliptical and cylindrical.

11. The multipurpose snuffer device of claim 1, wherein the circular lower cylinder comprises a hole on the upper portion, configured to receive and secure a tool.

12. The multipurpose snuffer device of claim 1, wherein the multipurpose snuffer device is constructed of silicone.

13. The multipurpose snuffer device of claim 1, wherein the multipurpose snuffer device has a height of about two inches, a width of about one inch, and a thickness of about one quarter inch.

14. The multipurpose snuffer device of claim 13, wherein the multipurpose snuffer device has a height of two inches, a width of one inch, and a thickness of one quarter inch.

* * * * *